US010926150B2

(12) United States Patent
Yablonowski et al.

(10) Patent No.: US 10,926,150 B2
(45) Date of Patent: Feb. 23, 2021

(54) TENNIS TRAINING APPARATUS

(71) Applicant: CPY 2 LLC, Naples, FL (US)

(72) Inventors: Cindy Yablonowski, Naples, FL (US); Randall Yablonowski, Plainfield, IN (US); James Yablonowski, Cedar Lake, IN (US)

(73) Assignee: CPY 2 LLC, Naples, FL (US)

( * ) Notice: Subject to any disclaimer, the term of this patent is extended or adjusted under 35 U.S.C. 154(b) by 0 days.

(21) Appl. No.: 16/130,643

(22) Filed: Sep. 13, 2018

(65) Prior Publication Data

US 2019/0083873 A1 Mar. 21, 2019

Related U.S. Application Data

(60) Provisional application No. 62/559,100, filed on Sep. 15, 2017.

(51) Int. Cl.
*A63B 69/38* (2006.01)
*A63B 59/40* (2015.01)
(Continued)

(52) U.S. Cl.
CPC ..... *A63B 69/38* (2013.01); *A63B 1/00* (2013.01); *A63B 21/00065* (2013.01);
(Continued)

(58) Field of Classification Search
CPC ..... A63B 69/38; A63B 69/385; A63B 59/40; A63B 60/00; A63B 21/0065;
(Continued)

(56) References Cited

U.S. PATENT DOCUMENTS 1,306,915 A 6/1919 Klamroth
2,819,081 A 1/1958 Touraine
(Continued)

FOREIGN PATENT DOCUMENTS

CN 100518867 C 5/2007
CN 203001843 U 1/2013
(Continued)

OTHER PUBLICATIONS

International Search Report and Written Opinion for PCT/US17/23333 (filing date Mar. 21, 2017) dated Jun. 12, 2017; Applicant: CPY 2 LLC.
(Continued)

*Primary Examiner* — Raleigh W Chiu
(74) *Attorney, Agent, or Firm* — Smith & Hopen, P.A.; Paul Murty

(57) ABSTRACT

A sports training/exercise apparatus attached to a swinging sports apparatus, typically a racquet and most specifically a tennis racquet. The apparatus includes a drag chute with a rigid member disposed therearound and a clamp secured to each side of the drag chute. A transverse support rod is positioned between the clamps and includes an aperture therein. The apparatus further includes brackets at the top and bottom of the racquet head. A longitudinal support rod is positioned between the brackets and extends through the aperture in the transverse support rod. Thus, the transverse support rod, the side clamps, and the drag chute are slidable along the longitudinal support rod to adjust resistance. A locking mechanism can be used to lock the transverse support rod in a position along the longitudinal support rod.

2 Claims, 12 Drawing Sheets

(51) Int. Cl.

| | |
|---|---|
| ***A63B 60/00*** | (2015.01) |
| ***A63B 21/008*** | (2006.01) |
| ***A63B 21/00*** | (2006.01) |
| ***A63B 23/12*** | (2006.01) |
| ***A63B 1/00*** | (2006.01) |
| *A63B 102/08* | (2015.01) |
| *A63B 102/02* | (2015.01) |
| *A63B 102/04* | (2015.01) |
| *A63B 102/06* | (2015.01) |

(52) U.S. Cl.
CPC .... *A63B 21/00069* (2013.01); *A63B 21/0088* (2013.01); *A63B 23/1245* (2013.01); *A63B 59/40* (2015.10); *A63B 60/00* (2015.10); *A63B 2102/02* (2015.10); *A63B 2102/04* (2015.10); *A63B 2102/06* (2015.10); *A63B 2102/065* (2015.10); *A63B 2102/08* (2015.10)

(58) Field of Classification Search
CPC ..... A63B 21/0069; A63B 21/0088; A63B 23/1245; A63B 1/00; A63B 2102/02; A63B 2102/04; A63B 2102/06; A63B 2102/065; A63B 2102/08
See application file for complete search history.

(56) References Cited

U.S. PATENT DOCUMENTS 3,820,785 A * 6/1974 Occhipinti et al. .... A63B 51/04 473/463
4,183,526 A 1/1980 Brown
4,576,378 A 3/1986 Backus
5,100,148 A 3/1992 Smith
5,165,683 A 11/1992 Beutler et al.
5,184,825 A 2/1993 Ruth
5,186,699 A 2/1993 Dimmig
5,207,625 A 5/1993 White
5,217,186 A * 6/1993 Stewart ..... A63B 21/0088 244/142
5,310,188 A 5/1994 Hernberg
5,335,918 A 8/1994 Rupnik et al.
5,405,139 A 4/1995 Gagarin
5,415,406 A 5/1995 Reichenbach et al.
5,472,394 A * 12/1995 Michaelson ..... A63B 21/0088 244/142
5,501,451 A * 3/1996 Slusarczyk ..... A63B 21/0088 473/459
5,571,048 A 11/1996 Kenney
5,803,838 A 9/1998 DeMarini et al.
5,865,686 A 2/1999 MacGregor
5,897,469 A 4/1999 Yalch
6,013,013 A 1/2000 Wolf
6,238,299 B1 5/2001 Barnette
6,325,727 B1 12/2001 Carr
6,881,156 B1 4/2005 Phillips
7,004,850 B1 2/2006 Hong
7,118,490 B2 10/2006 Namba
7,285,055 B2 10/2007 Radle
7,384,344 B2 * 6/2008 Aguirre ..... A63B 15/00 473/219
7,497,785 B2 3/2009 Koncelik, Jr.
7,762,929 B1 * 7/2010 Celone ..... A63B 69/3632 482/109
8,092,322 B1 1/2012 Smallcomb et al.
8,202,204 B2 * 6/2012 Celone ..... A63B 21/0088 116/174
8,409,037 B2 4/2013 Imatoh
8,905,871 B2 12/2014 Wagner et al.
8,998,740 B2 4/2015 Corcoran et al.
9,259,636 B1 2/2016 Bailey
9,539,482 B2 1/2017 Parnell
9,555,303 B1 1/2017 Novosel, Sr.
9,636,560 B1 * 5/2017 Celone ..... A63B 69/0002
9,662,524 B1 * 5/2017 Celone ..... A63B 21/00061
10,155,147 B1 * 12/2018 Yablonowski ..... A63B 69/0002
2004/0063519 A1 4/2004 Liberatore
2005/0215339 A1 * 9/2005 Namba ..... A63B 21/0088 473/228
2006/0009314 A1 1/2006 Bilsey
2008/0261730 A1 10/2008 Mullin
2010/0234146 A1 9/2010 Mullin
2010/0331125 A1 * 12/2010 Enday ..... A63B 69/38 473/463
2011/0009208 A1 1/2011 Roger et al.
2014/0113752 A1 4/2014 Westcott
2014/0243170 A1 8/2014 Shiozaki
2016/0074728 A1 * 3/2016 Arzola ..... A63B 21/0088 473/424
2017/0355462 A1 * 12/2017 Hoheisel ..... B64D 1/12
2019/0083873 A1 * 3/2019 Yablonowski ..... A63B 69/38

FOREIGN PATENT DOCUMENTS

JP 2013-233193 A 11/2013
WO 2014075150 A1 5/2014

OTHER PUBLICATIONS

International Preliminary Report on Patentability for PCT/US17/23333 (filing date Mar. 21, 2017) dated Mar. 21, 2016; Applicant: CPY 2 LLC.
International Search Report and Written Opinion for PCT/US17/36305 (filing date Jun. 7, 2017) dated Aug. 28, 2017; Applicant: CPY 2 LLC.
International Preliminary Report on Patentability for PCT/US17/36305 (filing date Jun. 7, 2017) dated Jun. 16, 2016; Applicant: CPY 2 LLC.
Translation of Chinese Patent No. CN100518867 with a publication date of Jul. 29, 2009.
Translation of Chinese Patent No. CN203001843 with a publication date of Jun. 19, 2013.
Translation of Japanese Patent No. JP2013-233193A with a publication date of Nov. 21, 2013.

* cited by examiner

With two chutes, the area inside the yellow lines continues to provide resistance.

TENNIS TRAINING APPARATUS

CROSS-REFERENCE TO RELATED APPLICATIONS

This nonprovisional application is a continuation of and claims priority to U.S. Provisional Patent Application Ser. No. 62/559,100, entitled "Tennis Training Apparatus," filed on Sep. 15, 2017, by the same inventors; and is tangentially related to U.S. Nonprovisional patent application Ser. No. 15/683,311, entitled "Baseball Training Device", filed on Aug. 22, 2017, by the same inventors; both of which are incorporated herein by reference in its entirety.

BACKGROUND OF THE INVENTION

1. Field of the Invention

This invention relates, generally, to sports exercise equipment. More specifically, it relates to a device that exercises muscles and improves performance in sports that require swinging an apparatus, e.g., racquet sports such as tennis, badminton, squash, and racquetball, among others.

2. Brief Description of the Prior Art

Sports training devices are known in the art for aiding in the swinging motion of a piece of sporting equipment, such as a baseball bat. However, they fail to teach or suggest a mechanism that allows a range of motion with adjustable resistance levels, without becoming entangled around the shaft of the club, bat, stick, or racquet.

Examples of such training devices are CN100518867C, CN203001843U, JP2013233193A, U.S. Pat. Nos. 4,183,526, 5,186,699, 5,501,451, 5,897,469, 7,384,344, 9,259,636, 9,539,482, 9,555,303, 9,662,524, US20040063519A1, US20060009314A1, US20100234146A1, US20100331125A1, US20140113752A1, and U520140243170A1. As can be seen in the conventional art, there are multiple training apparatuses for different swinging sports devices for providing resistance during a swing of the swinging sports device. However, when referring specifically to racquet sports, primarily tennis, there are no known methodologies for affixing a panel/chute/airfoil at a spaced distance away from the face of the racquet. For this reason, most training devices for racquet sports simply wrap the racquet head in a stretchable fabric. A disadvantage of this mechanism is the inability to adjust resistance and the inability to strike a ball while using the training device since the racquet face/strings are covered.

Collectively, previous devices have allowed for swing resistance; however, these devices must utilize a static air foil or risk becoming entangled around the shaft of the club, bat, stick, or racquet, and they only offer a single level of resistance.

Accordingly, what is needed is an improved racquet sports training device that provides an adjustable air resistance for training, regardless of their skill level or need. However, in view of the art considered as a whole at the time the present invention was made, it was not obvious to those of ordinary skill in the field of this invention how the shortcomings of the prior art could be overcome.

All referenced publications are incorporated herein by reference in their entirety. Furthermore, where a definition or use of a term in a reference, which is incorporated by reference herein, is inconsistent or contrary to the definition of that term provided herein, the definition of that term provided herein applies and the definition of that term in the reference does not apply.

While certain aspects of conventional technologies have been discussed to facilitate disclosure of the invention, applicants in no way disclaim these technical aspects, and it is contemplated that the claimed invention may encompass one or more of the conventional technical aspects discussed herein.

The present invention may address one or more of the problems and deficiencies of the prior art discussed above. However, it is contemplated that the invention may prove useful in addressing other problems and deficiencies in a number of technical areas. Therefore, the claimed invention should not necessarily be construed as limited to addressing any of the particular problems or deficiencies discussed herein.

In this specification, where a document, act or item of knowledge is referred to or discussed, this reference or discussion is not an admission that the document, act or item of knowledge or any combination thereof was at the priority date, publicly available, known to the public, part of common general knowledge, or otherwise constitutes prior art under the applicable statutory provisions; or is known to be relevant to an attempt to solve any problem with which this specification is concerned.

BRIEF DESCRIPTION OF THE DRAWINGS

For a fuller understanding of the invention, reference should be made to the following detailed description, taken in connection with the accompanying drawings, in which.

DETAILED DESCRIPTION OF THE INVENTION

Figure 1A:
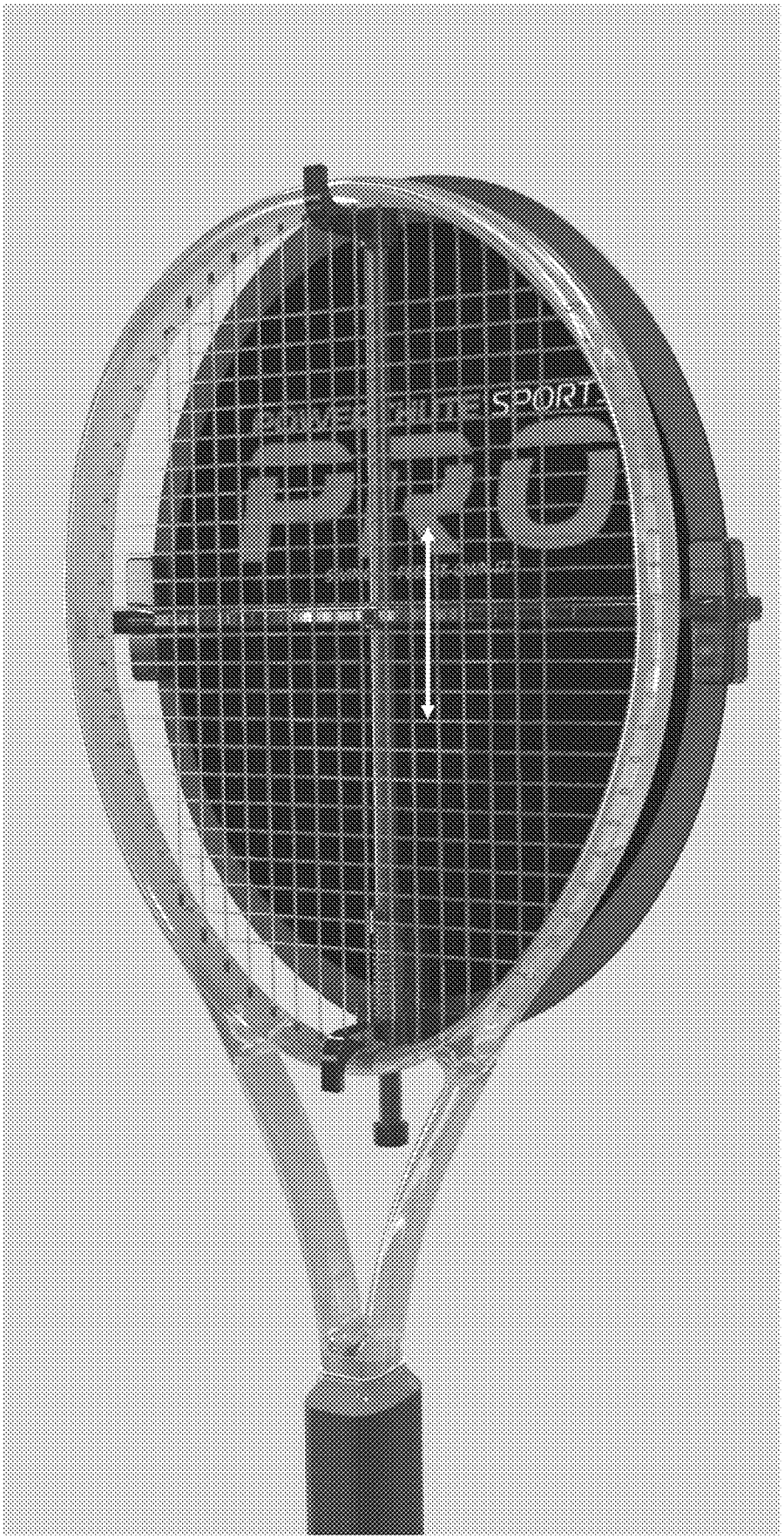
FIG. 1A is a perspective view of a sports swinging exercise and training apparatus, according to an embodiment of the current invention.
Figure 1B:
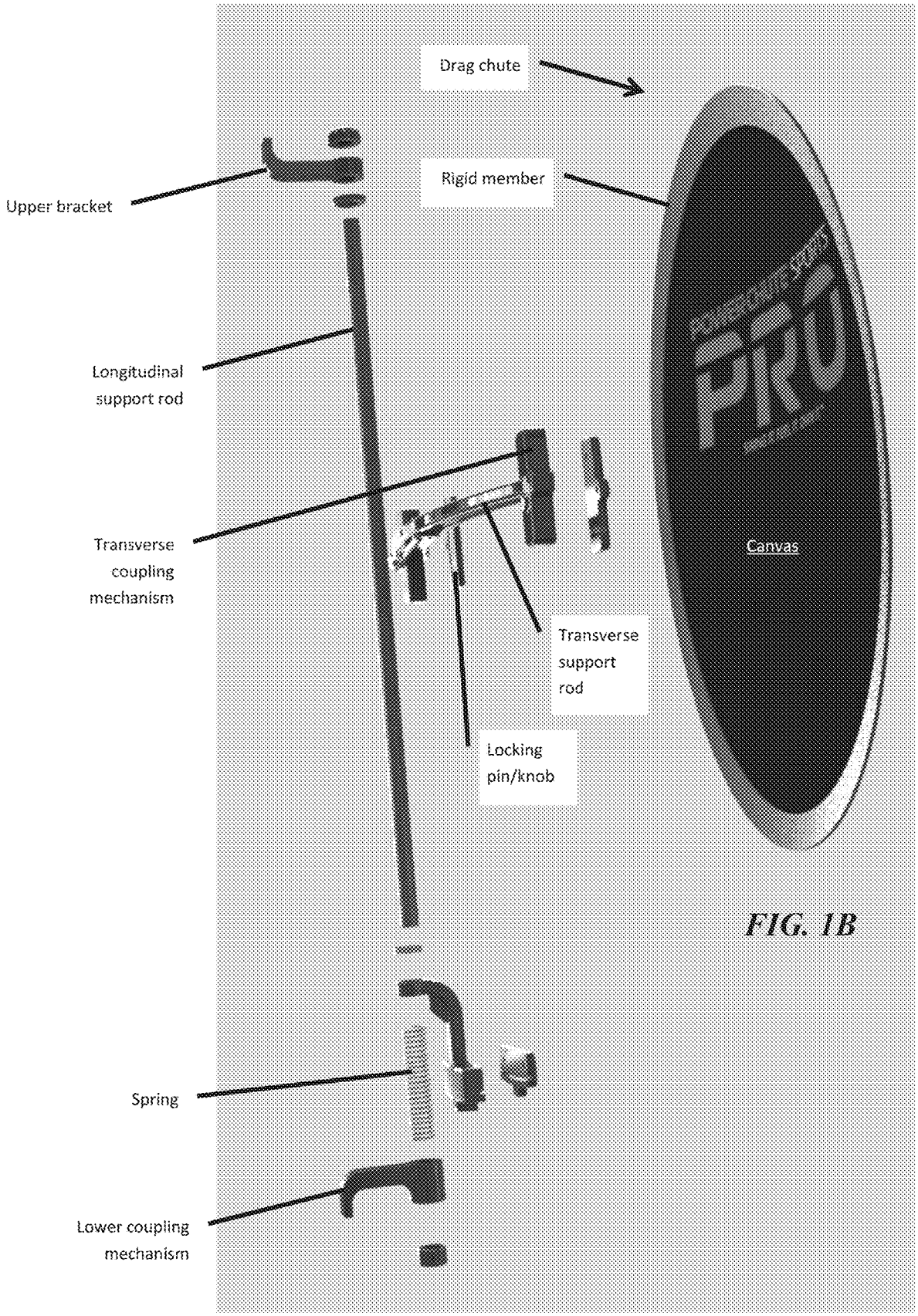
FIG. 1B is an exploded view of the sports swinging exercise and training apparatus of FIG. 1A.

In the following detailed description of the preferred embodiments, reference is made to the accompanying drawings, which form a part thereof, and within which are shown by way of illustration specific embodiments by which the invention may be practiced. It is to be understood that other embodiments may be utilized and structural changes may be made without departing from the scope of the invention.

As used in this specification and the appended claims, the singular forms "a", "an", and "the" include plural referents unless the content clearly dictates otherwise. As used in this specification and the appended claims, the term "or" is generally employed in its sense including "and/or" unless the context clearly dictates otherwise.

In certain embodiments, the current invention is a swinging sports exercise and training device designed for attachment to the shaft of a swinging sports apparatus, such as a racquet (tennis, badminton, squash, racquetball, paddle ball, etc.). The invention will be described and illustrated herein as applied to a tennis racquet, but it can be understood how the device can be applied to other racquet sports apparatuses as well.

Particular examples of the training device can be seen in FIGS. 1A-1B and 2A-2H. As shown in the figures, the training device generally includes a drag chute and at least two connection points to the racquet. It is contemplated that the training device can be coupled to the racquet at a single connection point, such as to the strings at the center of the racquet. In any case, a spaced distance exists between the racquet strings and the drag chute. The drag chute is positioned only on one side of the racquet head, such that the drag chute trails behind the racquet during a swing of the racquet. Alternatively, it is contemplated herein that the training device can also be used in front of the racquet and/or on both sides of the racquet. The drag chute typically has a circular or ovular shape to match the shape of the racquet head, so that the chute experiences all of the air/wind flowing through the racquet strings during a swing of the racquet head. However, it can be understood that the drag chute can take any shape or form. Further, the drag chute can be formed of any suitable material, such as a lightweight and flexible fabric or canvas, a plastic film or sheet, a carbon fiber sheet, aluminum, etc.

The drag chute may further include a rigid member disposed along the edges of the canvas. If the drag chute takes a circular/ovular shape, then the rigid member can be disposed around the circumference of the canvas, as can be seen in the figures. If the drag chute takes another shape, such as a rectangle or trapezoid as seen in U.S. Pat. No. 9,662,524, then multiple rigid members can be used and disposed along select edges of the canvas. The rigid member(s) is used to stabilize the drag chute during a swing of the racquet. Alternatively, it is contemplated herein that if a more rigid chute material is used (e.g., plastic sheet, carbon fiber, aluminum, or other similar material is used), a rigid member may not be needed.

As discussed, the device has at least two connection points on the racquet, one of which is disposed at one end/portion of the racquet head and the other of which is disposed at an opposite end/portion of the racquet head. For example, one connection point can be at a proximal end/portion of the racquet head, and the other connection point can be at a distal end/portion of the racquet head, where the connection points are diametrically opposed to each other. The term "proximal." is used herein to refer to a relative position of a structural component being closer to a user of the underlying swinging sports apparatus. The term "distal" is used herein to refer to a relative position of a structural component being further from the user of the underlying swinging sports apparatus. The distal connection point typically is disposed near one end of the corresponding component or underlying device, and the proximal connection point typically is disposed near an opposite end of the corresponding component or underlying device. As another example, the connection points can be disposed at the left and right sides of the racquet head, where the connection points are also diametrically opposed to each other. It can be understood that rather than the connection points being exactly "diametrically opposed" to each other, the connection points can be generally opposed to each other on one side of the racquet head. Yet another embodiment can include more than two connection points spaced apart around the frame of the racquet head. These general configurations will become clearer as this specification continues.

Figure 3:
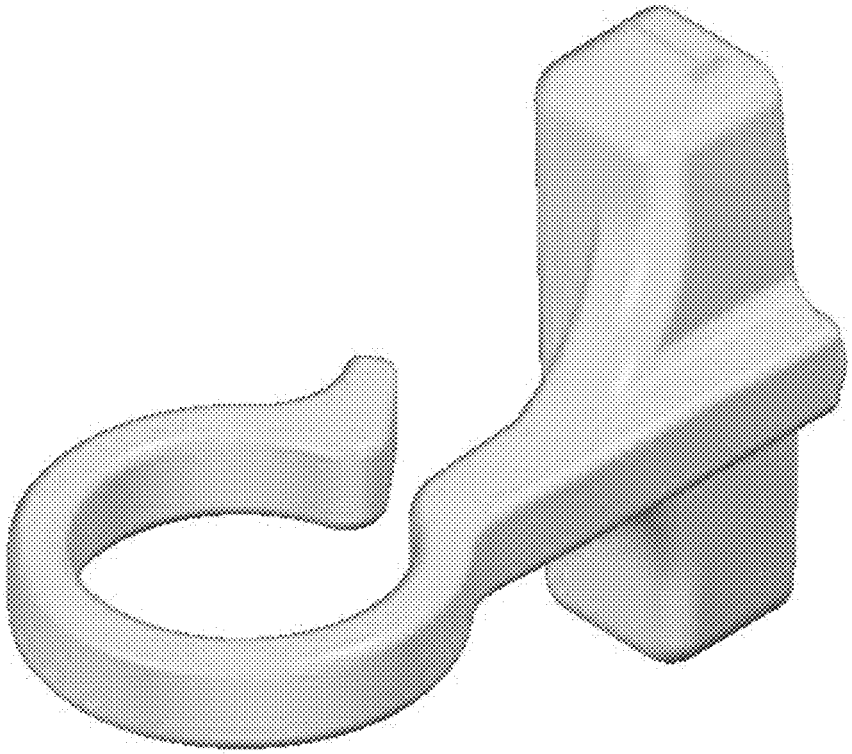
FIG. 3 is an isolated perspective view of a coupling mechanism in the form of a clip, according to an embodiment of the current invention.

Structurally, these connection points can be formed between the annular/ovular frame of the racquet head and a coupling mechanism secured to the drag chute. Examples of such a coupling mechanism include, but are not limited to, pipe clips, snap clamps, clasps, hasps, catches, hooks, buckles or any other suitable mechanism that can be used to accomplish the function and structural configuration described herein. This coupling mechanism typically has a diameter or inner dimension that is larger than a width or outer dimension of the racquet frame. As such, the coupling mechanism of the training device can be easily connected to the frame of the racquet by positioning the coupling mechanism around the racquet frame. An example of the coupling mechanism taking the form of a clip can be seen in FIG. 3.

Alternatively, the coupling mechanism can take the form of a bracket, such as an L- or U-shaped bracket, as seen in FIGS. 1A-1B and 2A-2H. The following description will discuss these brackets secured at the distal/top and proximal/bottom ends of the racquet head, but it can be understood that the positioning of the brackets on the racquet head can vary according to the needs of the user. Typically, however, the brackets are positioned on opposite ends of the racquet head, so that the drag chute is stabilized when trailing the racquet head during a swing of the racquet.

When the training device is installed on the racquet, in order to couple the distal end of the racquet to the training device, the upper/distal bracket coupling mechanism extends from the distal end of the drag chute (creating the spaced distance between the chute and racquet strings), through a gap in the racquet strings, and upward/distally beyond the top/distal edge of the racquet head. Similarly, the lower/proximal bracket coupling mechanism extends from the proximal end of the drag chute (creating the spaced distance between the chute and racquet strings), through a gap in the racquet strings, and downward/proximally beyond the bottom/proximal edge of the racquet head. Through this structure, the racquet is securely coupled to the training device, such that the training device will remain in place on the racquet during a swing thereof.

It is understood herein that not all racquets have the same head size, either in length or width, though most head sizes are between about 85 $in^2$ and about 135 $in^2$, with most of these being between about 95 $in^2$ and about 110 $in^2$. Thus, if the brackets can have a distance between them of about twelve (12) inches or more, then this distance would be larger than a vast majority of racquet head lengths. In this scenario, to install the training device on the racquet head, the distance between the brackets would need to be decreased for example by compressing the lower bracket toward the upper bracket (or vice versa) This compression can be achieved by utilizing a coil spring that is biased toward a position of expansion. When the spring is compressed, the lower bracket can move toward the upper bracket until the bracket can be inserted through a gap in the racquet strings and be secured to the racquet frame. Further, the upper bracket would be similarly positioned at the distal end of the racquet frame. In this case, the upper bracket would exert an upward force on an inner surface of the distal racquet head frame, and the lower bracket would exert a downward force on an inner surface of the proximal racquet head frame.

It can be understood by one of ordinary skill in the art that the general mechanism of fitting the training device to various-sized racquet heads can be accomplished in a variety of manners. For example, rather than the distance between the brackets being larger than the maximum length of a racquet head, the distance can be smaller than the minimum length of a racquet head, and a coil spring biased toward compression can be used to expand the distance between the brackets. A clip or other mechanism can then be used to secure the training device to the racquet frame, where forces are exerted inwardly on the outer surfaces of the racquet frame.

The training device may further include a longitudinal support rod disposed between the upper and lower coupling mechanisms. The longitudinal support rod may also be directly connected to the upper and lower coupling mechanisms to maintain the distance therebetween and to maintain stability of the chute during a swing of the racquet.

The figures depict the previously-discussed spring on the exterior of the proximal end of the longitudinal support rod. In other embodiments, the spring can be positioned within an interior of the support rod (not shown). In this case, two rods would be disposed along the training device, rather than just one. The rods would include a smaller rod/tube and a larger rod/tube, where the spring would fit inside the larger tube. The smaller tube would then be inserted into the larger tube and would contact the spring. The spring can then perform the same function as discussed previously but would be internally located, so as to not be exposed to the external environment.

In certain embodiments, the current invention provides for adjustable resistance experienced by a user swinging the racquet. In this case, the upper and lower coupling mechanisms may not be attached to the drag chute at all. Rather, the training device may further include a transverse support rod extending between two opposing sides of the drag chute, where the transverse support rod is disposed substantially parallel to the longitudinal support rod. The transverse support rod is secured to the drag chute on each side using transverse coupling mechanisms; this can be accomplished in any suitable manner, for example clamps.

Figure 2A:
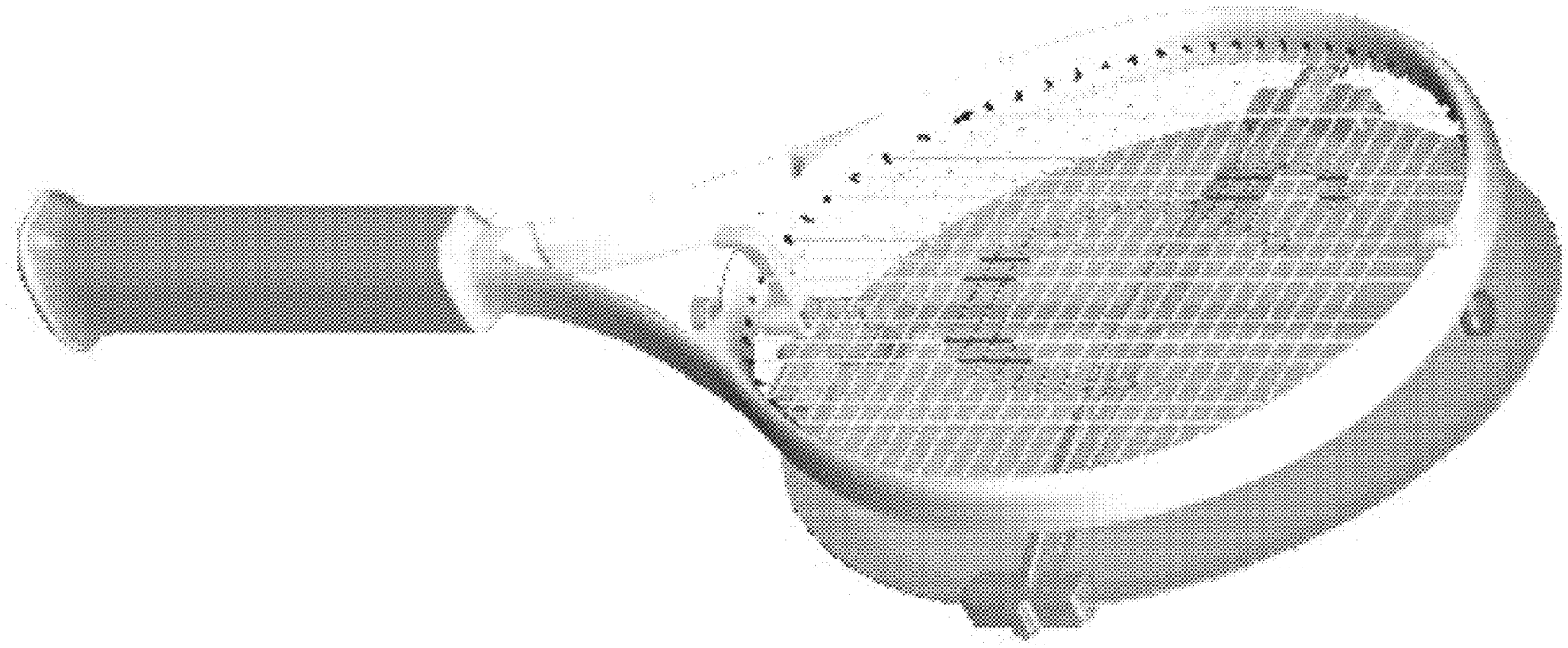
FIG. 2A is a perspective view of a sports swinging exercise and training apparatus, according to an embodiment of the current invention.
Figure 2B:
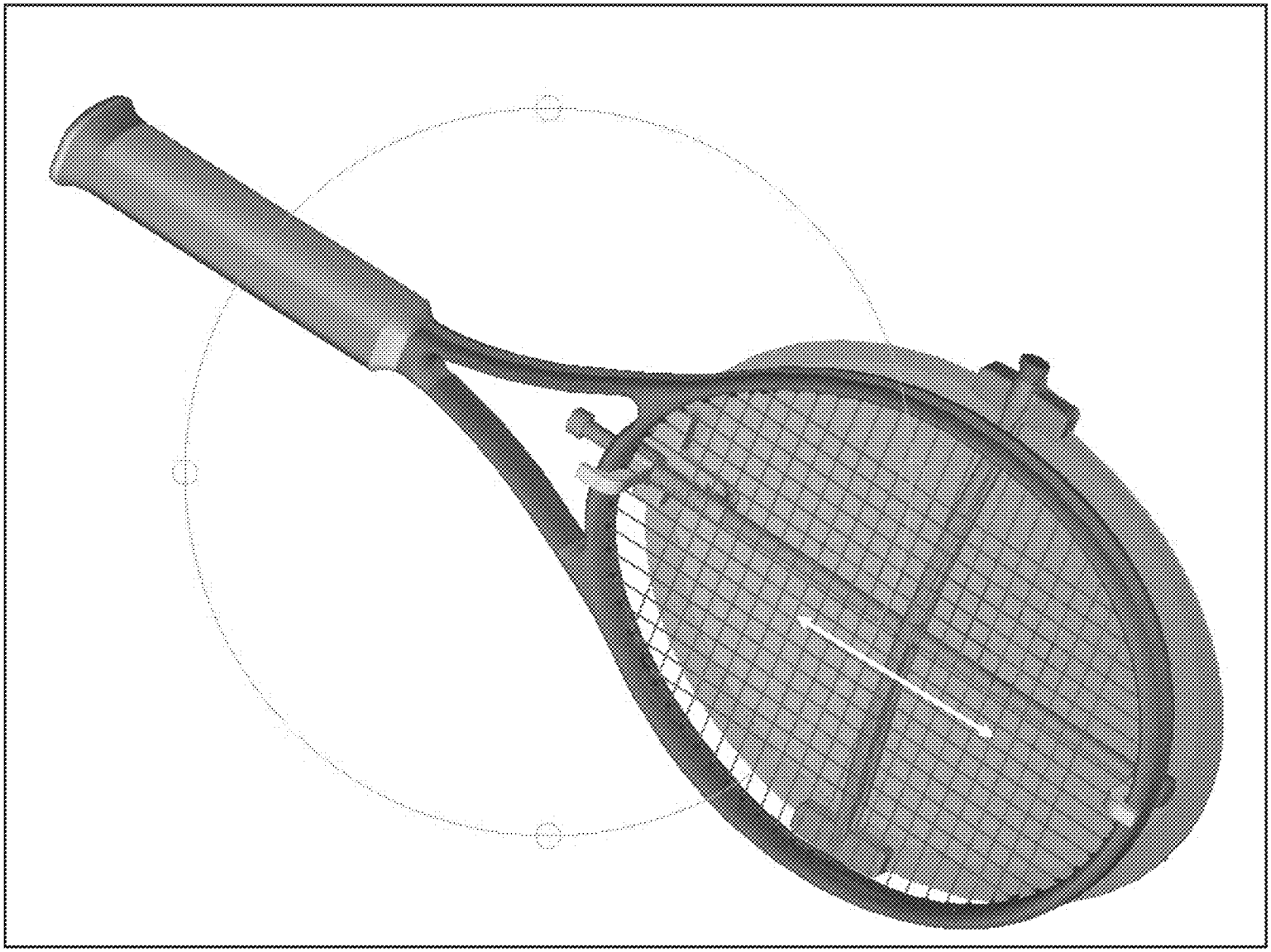
FIG. 2B is an alternative perspective view of the sports swinging exercise and training apparatus of FIG. 2A.
Figure 2C:
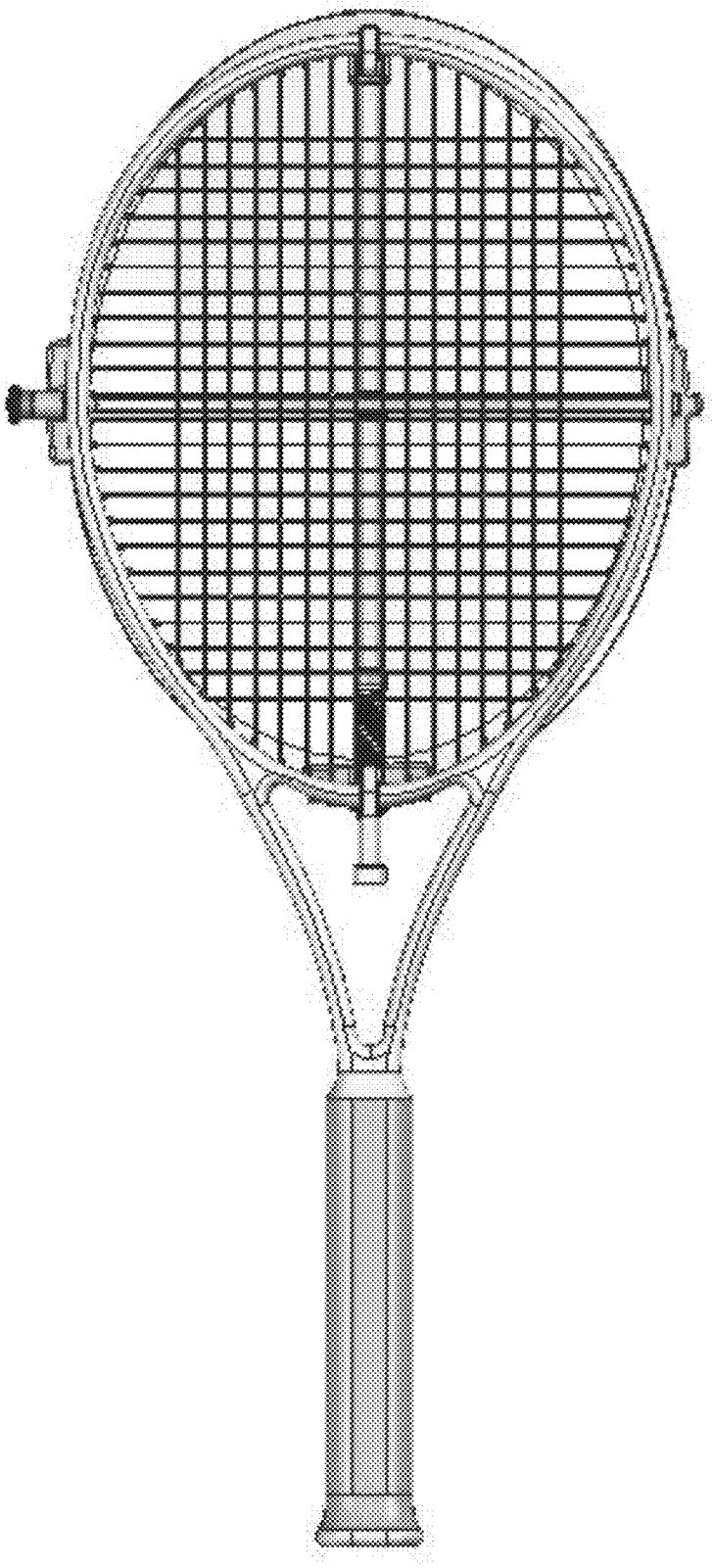
FIG. 2C is a front elevated view of the sports swinging exercise and training apparatus of FIG. 2A.
Figure 2D:
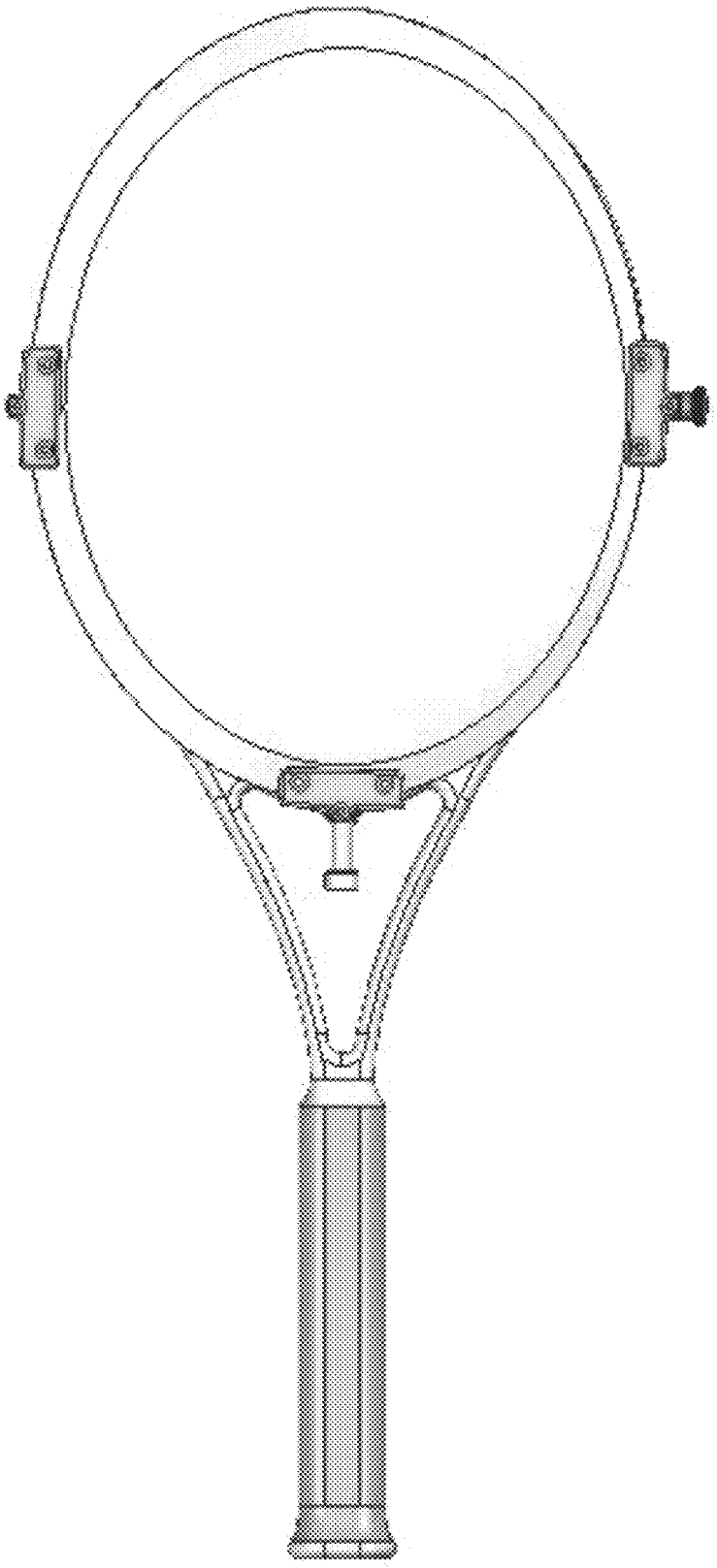
FIG. 2D is a rear elevated view of the sports swinging exercise and training apparatus of FIG. 2A.
Figure 2E:
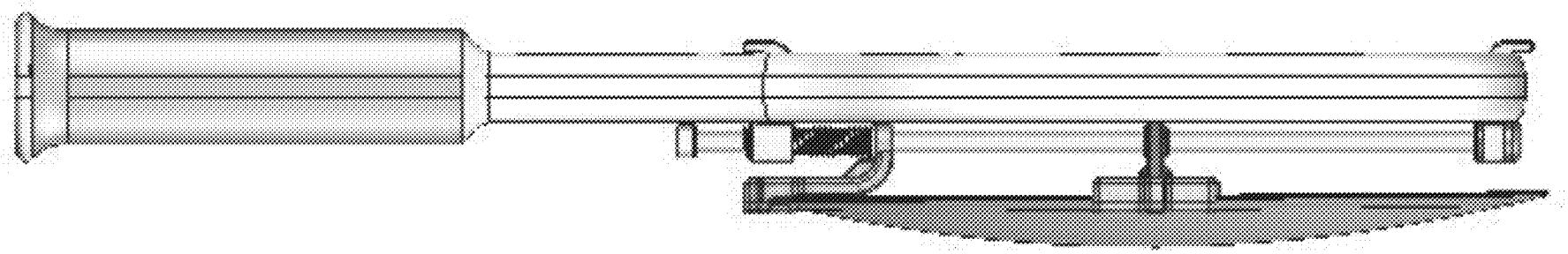
FIG. 2E is a side elevated view of the sports swinging exercise and training apparatus of FIG. 2A.
Figure 2F:
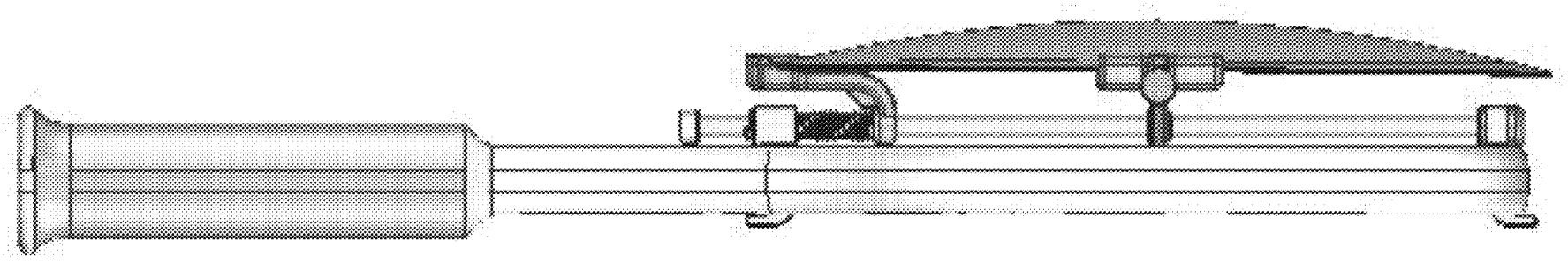
FIG. 2F is an opposite side elevated view of the sports swinging exercise and training apparatus of FIG. 2A.
Figure 2G:
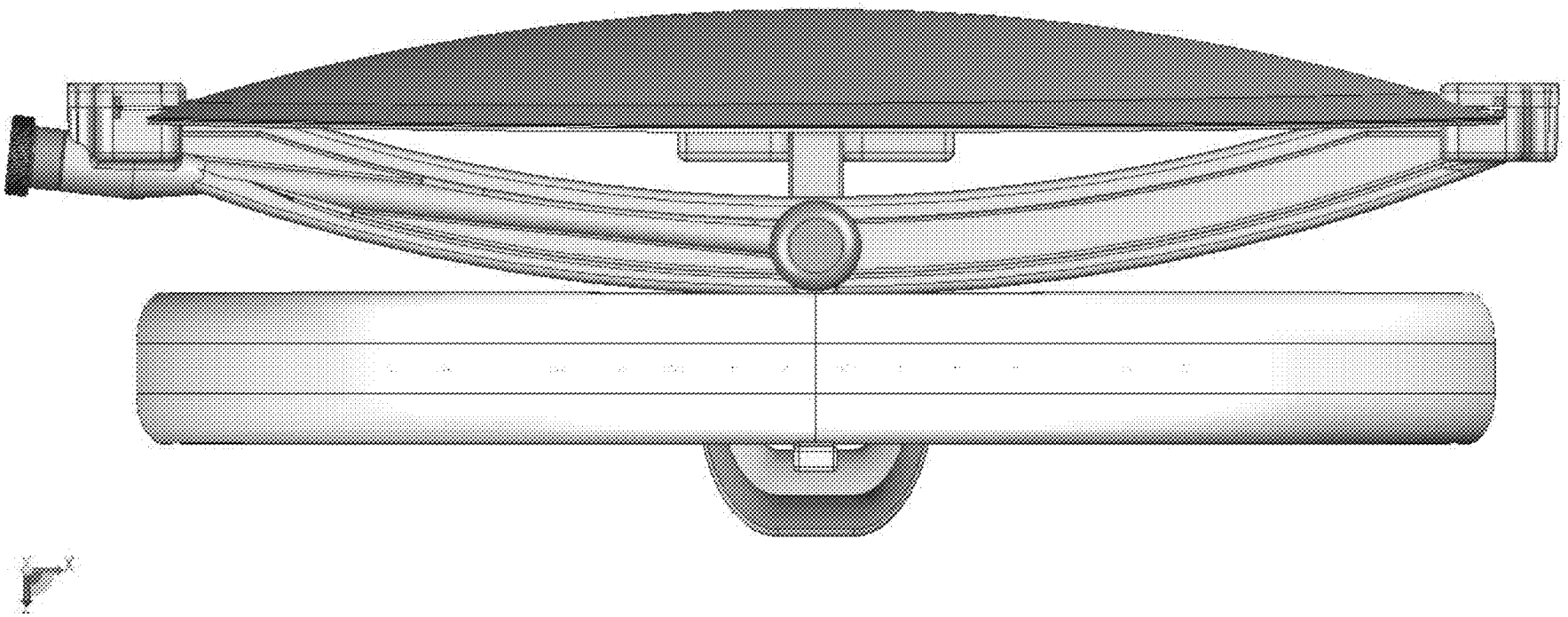
FIG. 2G is a top end view of the sports swinging exercise and training apparatus of FIG. 2A.
Figure 2H:
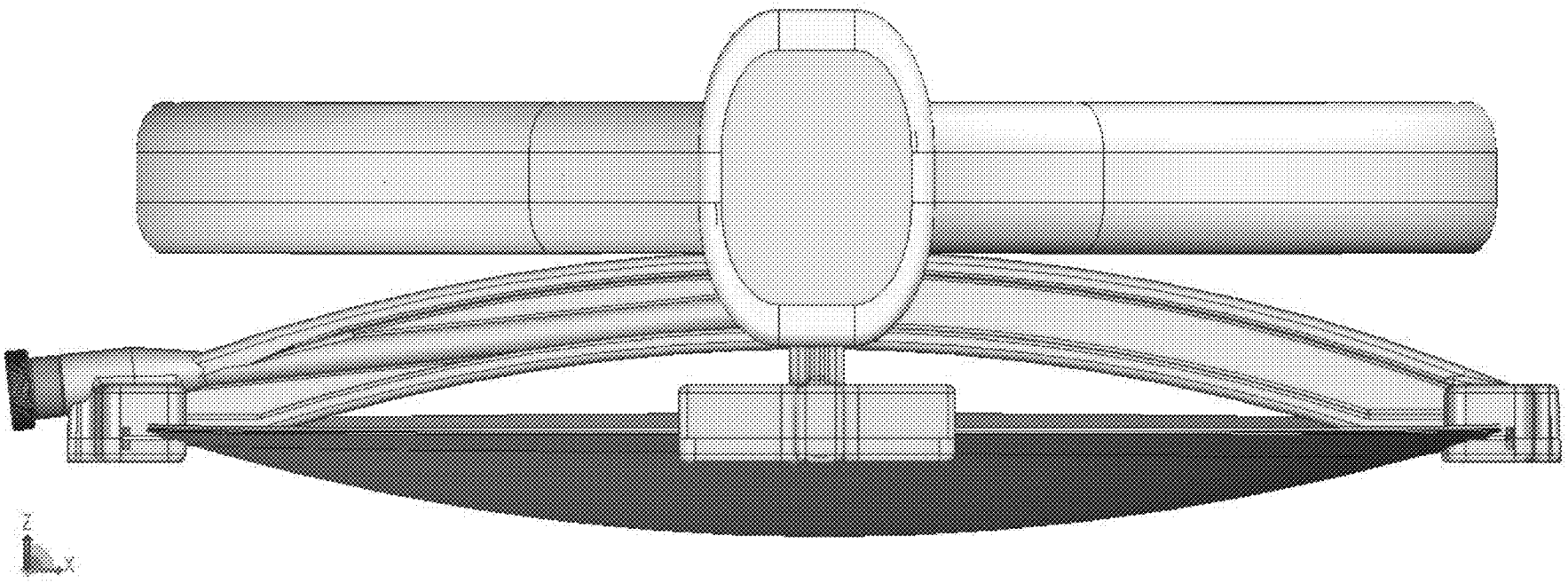
FIG. 2H is a bottom end view of the sports swinging exercise and training apparatus of FIG. 2A.

To provide adjustability of resistance, the transverse coupling mechanisms, the transverse support rod, and the drag chute are slidable along the longitudinal support rod in the direction indicated by the arrows in FIGS. 1A and 2A, while the upper and lower coupling mechanisms and the longitudinal support rod remain stationary and affixed to the racquet. The slidability of the transverse rod and drag chute can be accomplished in any suitable manner, for example interlocking flanges and channels. Another example is rather than a transverse support rod being present, a second longitudinal support rod (not shown) is present and attached to the drag chute, where the second longitudinal support rod is parallel to, in communication with, and slides along the affixed support rod.

Yet another example, depicted in the figures, is an aperture disposed within the transverse support rod with the longitudinal support rod extending therethrough, such that the transverse rod can slide up and down the length of the longitudinal support rod. In this way, the transverse coupling mechanisms, the transverse support rod, and the drag chute slide in unison along the longitudinal support rod. It should be noted that as the drag chute (along with the transverse support rod) moves distally, including beyond the distal end of the racquet head, drag resistance experienced by the user increases. As the drag chute (along with the transverse support rod) moves proximally, including beyond the proximal end of the racquet head, drag resistance experienced by the user decreases.

Although resistance is adjustable, a user may wish for the resistance to be fixed while swinging the racquet or otherwise during a practice session. Any suitable mechanism can be used to secure or lock the transverse support rod in place, thus also locking the drag chute in place. When the transverse support rod is not slidable along the longitudinal support rod, it is fixed in place and the training device can be used. When the transverse support rod is unsecured or unlocked from the longitudinal support rod, it can slide along the longitudinal support rod until the desired resistance is set, at which point it can be locked again. As shown in the figures, a locking knob/pin can be used to lock and unlock the transverse support rod.

Figure 4:
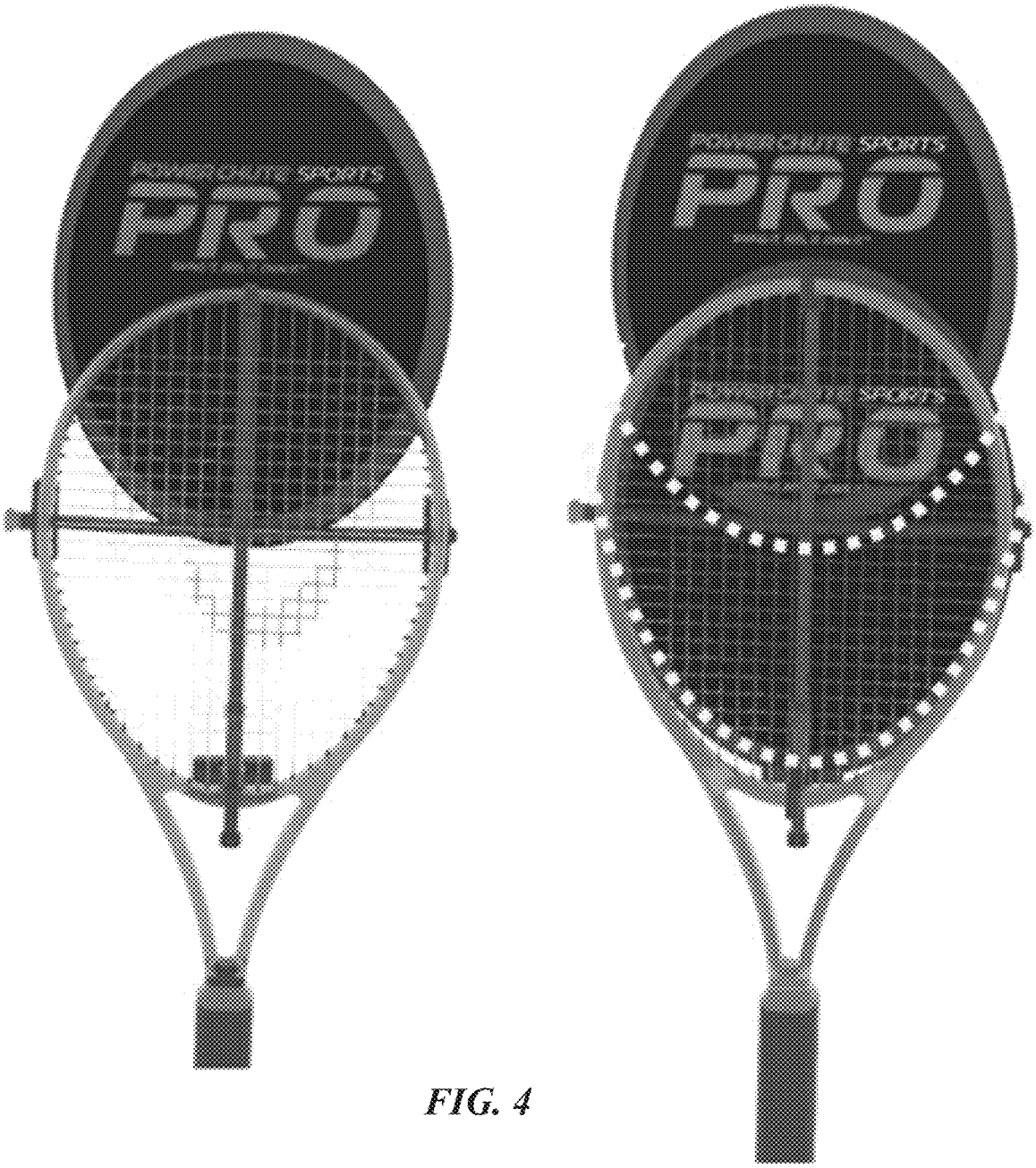
FIG. 4 depicts an alternative embodiment of the current invention, using two (2) drag chutes.

In an alternative embodiment, shown in FIG. 4, the training device may include two drag chutes, one position directly behind the other. One chute is stationary on the racquet, and the other is adjustable up and down the racquet. This configuration provides a benefit of further increased resistance, if desired.

GLOSSARY OF CLAIM TERMS

Chute: This term is used herein to refer to a typically flexible panel or airfoil that provides air resistance when swinging it in a direction normal to its plane.

Coupling Mechanism: This term is used herein to refer to a structural component by which the current training device remains adjoined to the swinging sports apparatus and moves in unison with the swing of the sports apparatus.

Distal: This term is used herein to refer to a position further from a user operating the underlying sports apparatus and training device.

Locked position: This term is used herein to refer to a position of the locking mechanism where the coupling elements are longitudinally affixed to the support rod, such that the coupling elements cannot slide along the support rod.

Locking mechanism: This term is used herein to refer to a structural component by which the coupling elements remains longitudinally affixed to the support rod.

Proximal: This term is used herein to refer to a position closer to a user operating the underlying sports apparatus and training device.

Rigid member: This term is used herein to refer to a structural component that provides a rigidity to an edge of the panel. This rigidity facilitates synchronized rotation of the training device about the shaft of the sports apparatus.

Sports apparatus: This term is used herein to refer to equipment that is swung during operation thereof when playing a sport. Examples include, but are not limited to, baseball bats, tennis racquets, golf clubs, and hockey sticks, among other suitable equipment.

Synchronization: This term is used herein to refer to two events occurring at the same time and with the same speed.

Training apparatus: This term is used herein to refer to any device or equipment that provides training for a particular sport or provides general exercise.

Unlocked position: This term is used herein to refer to a position of the locking mechanism where the coupling elements are not longitudinally affixed to the support rod, such that the coupling elements can slide along the support rod.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A training apparatus for attaching to a swinging sports apparatus, comprising:

a swinging sports apparatus having a circular/ovular racquet head including an upper side diametrically opposed from a lower side, and a left side diametrically opposed from a right side, such that each of the left and right sides join the upper side to the lower side;

a circular/ovular drag chute secured to the swinging sports apparatus, the drag chute including a resistance-providing member and a rigid member disposed therearound, wherein the rigid member maintains alignment of the drag chute and prevents twisting of the drag chute during a swing of the swinging sports apparatus, the drag chute secured to the swinging sports apparatus via at least two connections, the at least two connections including a first coupling mechanism and a second coupling mechanism;

the first coupling mechanism coupled to a first end of the drag chute, the first coupling mechanism securing the first end of the drag chute to the upper side of the swinging sports apparatus, the first coupling mechanism being an L- or U-shaped bracket;

the second coupling mechanism that coupled to a second end of the drag chute, the second coupling mechanism securing the second end of the drag chute to the lower side of the swinging sports apparatus, such that the second coupling mechanism is diametrically opposed to the first coupling mechanism, the second coupling mechanism being an L- or U-shaped bracket; and a longitudinal support rod coupled to each of the first coupling mechanism and the second coupling mechanism, the longitudinal support rod having a length that is larger than a length of the racquet head such that each of the first coupling mechanism and the second coupling mechanism surmounts the respective upper side and lower side of the swinging sports apparatus, wherein the first and second coupling mechanisms define a spaced distance between the drag chute and the swinging sports apparatus, such that a face of the drag chute is disposed substantially parallel to a face of the swinging sports apparatus, wherein the drag chute remains on one side of the swinging sports apparatus and trails the swinging sports apparatus during a swing thereof.

2. An exercise/training apparatus for attaching to a tennis racquet, wherein the tennis racquet has a racquet head including an upper side, a lower side, a left side, and a right side, the exercise/training apparatus comprising:

a circular or ovular drag chute formed of a flexible body with a rigid member disposed around the circumference of the flexible body, wherein the drag chute has a plane that is substantially parallel to a face of the tennis racquet, wherein the drag chute has an upper side, a lower side, a left side, and a right side;

a left clamp secured to the left side of the drag chute;

a right clamp secured to the right side of the drag chute;

a transverse support rod coupled to the left clamp and the right clamp, wherein the transverse support rod extends between the left clamp and the right clamp;

an aperture formed within a central portion of the transverse support rod;

an upper L- or U-shaped bracket configured to be secured to the upper side of the racquet head;

a lower L- or U-shaped bracket configured to be secured to the lower side of the racquet head;

a longitudinal support rod coupled to the upper bracket and the lower bracket, wherein the longitudinal support rod extends between the upper bracket and the lower bracket, wherein the longitudinal support rod extends through the aperture in the transverse support rod, such that the longitudinal support rod and the transverse support rod are positioned substantially perpendicular to each other, wherein the transverse support rod, the left clamp, the right clamp, and the drag chute are slidable proximally and distally along the length of the longitudinal support rod to adjust a resistance experienced by a user of the exercise/training apparatus;

a locking mechanism that locks and unlocks the transverse support rod, wherein in the locked position, the locking mechanism prevents movement of the transverse support rod along the longitudinal support rod, and in the unlocked position, the locking mechanism allows movement of the transverse support rod along the longitudinal support rod, wherein the longitudinal support rod has a length that is larger than a length of the racquet head; and a coil spring in communication with the upper bracket or the lower bracket, wherein the coil spring is biased toward a position of expansion, whereby upon compressing the coil spring, the upper and lower brackets are disposed closer to each other and can be secured to the racquet head.

* * * * *